US005254421A

United States Patent [19]

Coppens et al.

[11] Patent Number: 5,254,421

[45] Date of Patent: Oct. 19, 1993

[54] TONER RECEIVING PRINTING PLATE

[75] Inventors: Paul J. Coppens, Turnhout; Serge M. Tavernier, Lint; Robert F. Janssens, Geel; Paul Märksch, Antwerp; Marc P. Stevens, Belsele; Mikolaas C. de Jaeger, Hove, all of Belgium

[73] Assignee: AGFA-Gevaert, N.V., Mortsel, Belgium

[21] Appl. No.: 544,382

[22] Filed: Jun. 27, 1990

[30] Foreign Application Priority Data

Jun. 28, 1989 [EP] European Pat. Off. ..... 89201696.5

[51] Int. Cl.[5] ..... G03G 13/28

[52] U.S. Cl. ..... 430/49; 430/271; 101/465; 427/259; 427/469

[58] Field of Search ..... 430/49, 271; 101/465; 427/259, 14.1

[56] References Cited

U.S. PATENT DOCUMENTS 3,971,660 7/1976 Staehle ..... 430/271

4,444,858 4/1984 Nishibu et al. ..... 430/49

*Primary Examiner*—Marion E. McCamish

*Assistant Examiner*—S. Rosasco

*Attorney, Agent, or Firm*—Breiner & Breiner

[57] ABSTRACT

Electrophotographic method of obtaining lithographic printing plates comprising the following steps: (i) uniformly electrostatically charging a photoconductor element, (ii) image-wise discharging said photoconductor element, (iii) developing the resulting electrostatic charge pattern with dry toner particles of which more than 90% by volume have an equivalent particle size diameter less than 10 microns and more than 50% by volume have an equivalent particle size diameter less than 7 microns, (iv) electrostatically transferring the developed image to a toner receiving plate, said toner receiving plate comprising a plastic film support that is thermostable to a temperature of at least 140° C. and a crosslinked hydrophilic layer thereon, said layer containing infrared absorbing substances in such an amount that the reflection density of said layer in the visible spectrum is between 0.4 and 1.4, and (v) fixing the transferred toner to said toner receiving plate by infrared radiation fusing.

15 Claims, No Drawings

TONER RECEIVING PRINTING PLATE

The present invention relates to lithographic printing plates and more particularly to a method for obtaining lithographic printing plates by electrophotographic imaging.

Lithography is the process of printing from specially prepared surfaces, some areas of which are capable of accepting lithographic ink, whereas other areas, when moistened with water, will not accept the ink. The areas which accept ink form the printing image areas and the ink-rejecting areas form the background areas.

Generally, two different types of lithographic printing plates prepared by electrophotography have evolved.

One type of printing plate is produced by the following steps: (i) uniformly electrostatically charging a photoconductive layer, such as a coating of zinc oxide photoconductive pigment dispersed in a resin binder, by means of a corona-discharge, (ii) image-wise discharging said photoconductive layer by exposing it to electromagnetic radiation to which it is sensitive, (iii) applying electrostatically charged oleophilic toner particles to develop the resulting electrostatic charge pattern and (iv) fixing the toner to the photoconductive layer. Fixing is usually accomplished by the use of heat which causes the toner resin powder to coalesce and adhere to the photoconductive layer.

The copy sheet with the fused oleophilic image portions is then converted to a lithographic master by treatment with a conversion solution. The conversion step treats the photoconductive coating so that water receptive background areas are obtained. The ink receptive portions are the fused oleophilic toner images.

In another type of printing plate the toner image resulting from step (iii) is transferred from the photoconductive layer to a toner receiving plate on which the toner transfer image is then fixed. In this system the photoconductor can be reused after cleaning. The toner receiving plate does not need a photoconductive coating; any conventional lithographic coating will suffice. Depending on the coating used subsequent chemical treatment may be necessary to render the background areas water receptive.

An example of a toner receiving plate provided with a lithographic coating consisting of polyvinyl alcohol, tetraethyl orthosilicate, titanium dioxide and wetting agents is described in U.S. Pat. No. 3,971,660. However, printing plates obtained from these toner receiving plates applying conventional electrophotographic techniques do not yield the desired quality and resolution that can be obtained, for example, with the commercially available high quality and high resolution presensitized printing plates. A disadvantage of these presensitized printing plates is that the processing of these plates usually involves the use of chemicals and/or organic solvents. Another disadvantage of these plates is that they are only sensitive to ultraviolet radiation implying contact exposure and a film original.

It is a general object of this invention to provide high quality, high resolution lithographic printing plates with excellent press performance that are fully compatible with conventional lithographic inks and fountain solutions.

It is another object of this invention to provide a convenient and ecologically acceptable method to obtain said press-ready lithographic printing plates by use of electrophotographic imaging techniques wherein the photoconductor is reusable.

Other objects will become apparent from the description hereinafter.

The present invention provides an electrophotographic method of obtaining lithographic printing plates comprising the following steps: (i) uniformly electrostatically charging a photoconductor element, (ii) image-wise discharging said photoconductor element, (iii) developing the resulting electrostatic charge pattern with dry toner particles of which more than 90% by volume have an equivalent particle size diameter less than 10 microns and more than 50% by volume have an equivalent particle size diameter less than 7 microns, (iv) electrostatically transferring the developed image to a toner receiving plate, said toner receiving plate comprising a plastic film support that is thermostable to a temperature of at least 140° C. and a crosslinked hydrophilic layer thereon, said layer containing infrared absorbing substances in such an amount that the reflection density of said layer in the visible spectrum is between 0.4 and 1.4, and (v) fixing the transferred toner to said toner receiving plate by infrared radiation fusing.

The present invention further provides a lithographic printing plate precursor comprising a plastic film support that is thermostable to a temperature of at least 140° C. and a crosslinked hydrophilic layer thereon, said layer containing infrared absorbing substances in such an amount that the reflection density of said layer in the visible spectrum is between 0.4 and 1.4.

A plastic film that is thermostable to a temperature $T_1$ is a plastic film that meets the following requirements: the absolute value of the relative change in size at all temperatures below $T_1$ is less than $5\times10^{-3}$ and the absolute value of the derivative of the relative change in size to the temperature is less than $5\times10^{-5}$° C.$^{-1}$ at all temperatures below $T_1$. This applies to a change in length as well as to a change in width of the plastic film.

The size change and the rate of size change of a thermostable film can be measured in a Thermomechanical Analyzer TMS1 apparatus available from Perkin Elmer whereby the size change is measured while increasing the temperature at a rate of 5° C./min.

By applying the method according to the present invention lithographic printing plates of high quality and high resolution are obtained, i.e. lithographic printing plates with excellent lithographic properties that are dimensionally stable, that do not tear easily and that are capable of duplicating runs in the range of several tens of thousands of copies with good screen reproduction and substantially no fog or scumming.

Moreover, unlike most commercially available high resolution and high quality lithographic printing plates, the processing of the present printing plates does not involve the use of any solvent and is thus convenient to the consumer and harmless to the environment.

The invention will now be described in more detail.

The basic electrophotographic process steps of the present invention, i.e. charging, discharging, developing, transferring, fixing and the subsequent cleaning of the photoconductor are carried out according to techniques known in the art, as described, for example, in "Electrophotography" written by R. M. Schaffert and published by The Focal Press, London, Enlarged and Revised Edition, 1975.

It has been found that for obtaining the required dot resolution, toner particles of which more than 90% by volume have an equivalent particle size diameter less than 10 microns and more than 50% by volume have an equivalent particle size diameter less than 7 microns have to used in the development step of the present invention. Preferably toner particles of which more than 70% by volume have an equivalent particle size diameter between 4 and 6.5 microns are used. If the transferred toner particles are too large, fine detail in an image cannot be satisfactorily resolved.

Fine toner particles are described in, e.g., GB 2180948, EP 255716, U.S. Pat. No. 4,737,433 and JP 85/192711.

As is generally known, the toner is prepared by adding coloring material and other additives to molten resin and kneading until a homogeneous mixture is obtained. After cooling, the solid mass obtained is milled and micropulverized.

Thereafter so as to obtain toner particles corresponding to predetermined particle-sizes, a suitable particle classification method is employed. Typical particle classification methods include air classification, screening, cyclone separation, elutriation, centrifugation and combinations thereof.

The preferred method of obtaining the fine toner particles needed in the electrophotographic method of this invention is by centrifugal air classification.

Suitable milling and air classification results may be obtained when employing apparatus such as the A.F.G. (Alpine Fliessbeth Gegenstrahlmühle) type 100 combined with the A.T.P. (Alpine Turboplex Windsichter) type 50 G.S. as milling and air classification apparatus, the model being available from Alpine Process Technology Ltd., Rivington Road, Whitehouse, Industrial Estate, Runcorn, Cheshire. The size distribution of the so obtained toner particles can be determined in a conventional manner by employing a Coulter Counter type TA II/PCA1, model available from the Coulter Electronics Corp., Northwell Drive, Luton, Bedfordshire, LV 33 R4, United Kingdom.

In the mentioned air classification apparatus, air or some gas flows inwards in a spiral bath through a flat, cylindrical chamber. Particles contained in the air flow are exposed to two antagonistic forces, viz., to the inwardly directed tractive force of the air, and to the outwardly directed centrifugal force of the particle. In order to obtain a definite size of particles, that is, the "cut size", the two forces will be balanced. Larger (heavier) particles are dominated by the mass-dependent centrifugal force and the smaller (lighter) particles by the frictional force proportional to the particle diameter. Consequently, the larger or heavier particles fly outwards as coarse fraction, while the smaller or lighter ones are carried inwards by the air as fine fraction.

The coloring substance used in the toner particles may be any inorganic pigment (including carbon) or solid organic pigment or dye, or mixtures thereof commonly employed in dry electrostatic toner compositions. Thus, use can be made e.g. of carbon black and analogous forms thereof, such as lamp black, channel black, and furnace black e.g. SPEZIALSCHWARZ IV (trade name of Degussa Frankfurt/M, W. Germany) and CABOT REGAL 400 (trade name of Cabot Corp., High Street 125, Boston, USA).

The fact that infrared radiation is used in the present invention for fixing the toner to the plate implicates the presence of infrared absorbing substances in the toner. Due to these infrared absorbing substances sufficient heating is realised such as to lower the viscosity of the toner particles to such an extent that good fusing coalescence and penetration within the asperities of the plate is realised. Essentially the infrared absorbing substance is carbon black present within the toner. However, other infrared absorbing species may be used or added such as ammonium derivatives, naftalocyanines and carbocyanines.

Important with respect to the toner composition is the adequate choice of the main polymeric binder as the glass transition temperature must be sufficiently high (mor than 50° C., preferably more than 55° C.) whereas the viscosity during the fusing process should be sufficiently low (below 15000 P at 100 rad/s and 120° C., preferably below 7500 P) as high fusing temperatures are necessary when reaching the 15000 P range. Examples of useful commercially available polymeric binders are: ATLAC T500 sold by Imperial Chemical Industries, being a propoxylated bisphenol A fumaric acid ($T_g$=58° C., viscosity at 100 rad/s and 120° C.=2000 P) for the preparation of a negatively charged toner, Himer SAM 995 sold by Sanyo Chemical Industries being a styrene/dimethylaminoethyl methacrylate copolymer (85:15) ($T_g$=65° C., viscosity at 100 rad/s and 120° C.=5500 P) for the preparation of a positively charged toner, Epikote 1008 sold by Shell Chemical being a propoxylated bisphenol A epoxyde ($T_g$=61° C., viscosity at 100 rad/s and 120° C.=1500 P) for the preparation of a positively or a negatively charged toner, Himer SBM 100 sold by Sanyo Chemical Industries being a pure polystyrene ($T_g$=50° C., viscosity at 100 rad/s and 120° C.=2250 P) for the preparation of a positively or a negatively charged toner.

The toner can also contain besides the coloring substance, the infrared absorbing substances and the main resin, minor components such as charge control agents to enhance the chargeability in either negative or positive direction of the toner particles, flow enhancing agents, viscosity regulating agents, etc.

A very useful charge control agent for offering positive charge polarity is BONTRON NO4 (trade name of Oriental Chemical Industries, Japan) being a resin acid modified nigrosine dye. A very useful charge control agent for offering negative charge polarity is BONTRON S36 (trade name of Oriental Chemical Industries, Japan) being a metal complex dye.

Examples of flow enhancing additives are extremely fine inorganic or organic materials such as fumed inorganics (silica, alumina, zirconium oxide), metal soap and fluoro containing polymer particles of sub-micron size.

Examples of viscosity regulating agents are titanium dioxide, barium sulfate, calcium carbonate, ferric oxide, ferrosoferric oxide, cupric oxide.

After the desired toners are prepared, they can be incorporated into developers without further addenda. They can be used as such for single component developers. Alternatively, and preferably, the toners are combined with carrier particles to form two component developers.

The development may proceed by so-called cascading the toner particles over the imaging surface containing the electrostatic charge pattern or with magnetic brush. The carrier particles may be electrically conductive, insulating, magnetic or non-magnetic (for magnetic brush development they must be magnetic), as long as the carrier particles are capable of triboelectrically obtaining a charge of opposite polarity to that of the toner particles so that the toner particles adhere to and surround the carrier particles.

Useful carrier materials for cascade development include sodium chloride, ammonium chloride, aluminium potassium chloride, Rochelle salt, sodium nitrate, aluminium nitrate, potassium chlorate, granular zircon, granular silicon, silica, methyl methacrylate, glass. Useful carrier materials for magnetic brush development include steel, nickel, iron, ferrites, ferromagnetic materials, e.g. magnetite, whether or not coated with a polymer skin. Other suitable carrier particles include magnetic or magnetizable materials dispersed in powder form in a binder as described in e.g. U.S. Pat. No. 4,600,675.

Preferably the carriers are magnetic and can be used with a magnetic brush to form the developed images in accordance with this invention.

An ultimate coated carrier particle diameter between about 30 microns to about 1000 microns is preferred. The carrier may be employed with the toner composition in any suitable combination, generally satisfactory results have been obtained when about 1.5 to 15% by weight of toner based on the amount of carrier is used.

In developing an electrostatic image to form a positive reproduction of an original, the carrier particle composition and/or toner particle composition is selected so that the toner particles acquire a charge having a polarity opposite to that of the electrostatic latent image so that toner deposition occurs in image areas. Alternatively, in reversal reproduction of an electrostatic latent image, the carrier particle composition and toner particle composition is selected so that the toner particles acquire a charge having the same polarity as that of the electrostatic latent image resulting in toner deposition on the non-image areas.

After development the toner image is electrostatically transferred to a toner receiving plate. This transfer is effected by placing the toner receiving plate in contact with the developed toner image on the photoconductor, charging the plate electrically with the same polarity as that of the latent image and then stripping the plate from the photoconductor. The charge applied to the plate overcomes the attraction of the latent image for the toner particles and pulls them onto the plate.

The toner receiving plate of the present invention comprises a plastic film support and a crosslinked hydrophilic layer thereon.

The crosslinked hydrophilic layer contains a hydrophilic (co)polymer or (co)polymer mixture and a crosslinking agent.

As hydrophilic (co)polymers may be used, for example, homopolymers and copolymers of vinyl alcohol, acrylamide, methylol acrylamide, methylol methacrylate, acrylic acid, methacrylic acid, hydroxyethyl acrylate, hydroxyethyl methacrylate or maleic anhydride/-vinylmethylether copolymers. The hydrophilicity of the (co)polymer or (co)polymer mixture used is the same as or higher than the hydrophilicity of polyvinyl acetate hydrolyzed to at least an extent of 60 percent by weight, preferably 80 percent by weight.

Examples of crosslinking agents for use in the hydrophilic layer are hydrolyzed tetramethyl orthosilicate, hydrolyzed tetraethyl orthosilicate, diisocyanates, bisepoxides, melamine formol and methylol ureum.

The coating is preferably pigmented with titanium dioxide of pigment size which typically has an average mean diameter in the range of about 0.1 microns to 1 micron. Apparently, the titanium dioxide may even react with the other constituents of the layer to form an interlocking network forming a very durable printing plate. The titanium dioxide may be coated with for example aluminium dioxide. Other pigments which may be used instead of or together with titanium dioxide include silica or alumina particles, barium sulfate, magnesium titanate etc. and mixtures thereof. By incorporating these particles in the crosslinked hydrophilic layer of the present invention the mechanical strength of the layer is increased and the surface of the layer is given a uniform rough texture consisting of microscopic hills and valleys, which serve as storage places for water in background areas.

Preferably, the crosslinked hydrophilic layer of the present invention comprises a hydrophilic, homogeneous reaction product of polyvinyl alcohol, hyrolyzed tetra(m)ethyl orthosilicate and titanium dioxide.

The amount of crosslinking agent is at least 0.2 parts by weight per part by weight of hydrophilic (co)polymer, preferably between 0.5 and 2 parts by weight, most preferably 1 part by weight. The pigment is incorporated in an amount of between 1 and 10 parts by weight per part by weight of hydrophilic (co)polymer.

The above described crosslinked hydrophilic background layer has the desired hardness and degree of affinity for water to provide a long running lithographic printing plate with excellent toner adhesion and plate durability.

A very important step in the lithographic printing plate making method of the present invention is the fusing of the transferred toner image to the surface of the toner receiving plate so that it is strongly bonded thereto and will withstand the rigours of the lithographic printing process thereby producing a long running printing plate.

It has been found that for the method according to the present invention the fusing method by excellence is infrared radiation fusing.

In the hot roller fusing method, which is commonly used in electrophotographic techniques, the support with the toner image is simultaneously pressed and heated between a fuser roller and a pressure exerting roller. In order to prevent toner offset on the fuser roller the fuser roller is wetted with silicone oil.

Silicone oil renders the whole surface of the printing plate hydrophobe. This hydrophobic contamination of the printing plate surface will induce scumming, i.e. ink during the printing process in the non-image (i.e. non-toned) areas. Moreover, toner fog, i.e. spurious microscopic toner particles which are deposited in the non-image areas, is intensified due to the simultaneous heating and pressing of the toner particles onto the surface of the plate. Therefore, when hot roller fusing, although nowadays the preferred fusing method in common electrophotographic techniques, is used in the electrophotographic production method of printing plates, the desired quality can not be obtained.

In infrared radiation fusing the black image areas are selectively fused leaving unfused the spurious microscopic toner particles which are deposited in the non-image areas due to the fact that these spurious toner particles dissipate the radiation heat too quickly to fuse properly. The unfused particles at the end of the process usually fall off and do not appear on the lithographic plate. This phenomenon together with the fact that infrared radiation is a contactless fusing method leads to a decrease in toner fog, which benefits the quality of the printing plate.

Infrared absorbing materials are incorporated into the hydrophilic coating so that a unique balance is achieved whereby the coating is raised to a temperature above ambient so that all or most of the infrared radiation absorbed in the small dot areas is used efficiently to fuse all image portions so that they are firmly fixed to the layer. The rate of heat flow from the toner image is substantially reduced because the temperature differential between the image portions and the rest is substantially reduced thereby reducing the driving force that causes the rate of heat loss from the image. Therefore, the temperature required to cause the toner in the small dot areas to coalesce and fuse properly is substantially reduced thereby reducing the risk for the plastic support to melt or deform. Moreover, due to reduced temperature difference between image and non-image areas when infrared irridiated, differential shrinkage of the film support at these areas is reduced.

It has been found that, in order to sufficiently fuse the small dot areas and to avoid fusing of spurious toner particles, infrared absorbing substances have to be incorporated into the crosslinked hydrophilic layer of the present toner receiving plate in an amount to obtain a reflection density in the visible spectrum between 0.4 and 1.4, preferably between 0.6 and 1.

Examples of infrared absorbing substances include carbon black, black iron oxide ($Fe_3O_4$) and nigrosines, carbon black being preferred.

Into the crosslinked hydrophilic layer is dispersed carbon black, the particle size of which is preferably less than 1 micron, preferably between 200 nm and 300 nm.

According to a preferred embodiment of the present invention, the coating composition for the toner receiving plate is prepared by mixing together a dispersion of titanium dioxide in polyvinyl alcohol and a dispersion of carbon black in polyvinyl alcohol and by adding to the resulting dispersion hydrolyzed tetra(m)ethyl orthosilicate and polyvinyl alcohol. The amount of hydrolyzed tetra(m)ethyl orthosilicate in the coating composition is an amount corresponding to between 5 and 60%, preferably between 15 and 30% by weight of tetra(m)ethyl orthosilicate based on $TiO_2$, the amount of polyvinyl alcohol is between 10 and 50%, preferably between 15 and 30% by weight based on $TiO_2$ and the amount of carbon black is between 1 and 10%, preferably about 4% by weight based on the amount of titanium dioxide. Preferably some wetting agents are added to the coating composition.

In order to obtain stable dispersions the type of carbon black that is used (acid or basic carbon black) must be tuned to the type of $TiO_2$ used in combination with the pH of the layer. The dispersing agent that is used must also be properly selected in this respect.

The coating composition is thereafter coated on a thermostable plastic film support using any conventional coating method. A plastic film support, e.g. a polyester such as a polyethylene terephthalate, a polycarbonate, a polyphenylenesulfide or a polyetherketone support, has the advantage compared to a paper or polyethylene coated paper support that it does not tear that easily and that it is stronger.

Coating is preferably carried out at a temperature in the range of 30° to 38° C., preferably at 36° C.

The thickness of the crosslinked hydrophilic layer in the toner receiving plate of the present invention may vary in the range of 0.1 to 10 microns and is preferably 0.5 to 3 microns.

The plastic film support may be coated with a subbing layer to improve the adherence of the lithographic coating thereto. Between the support, whether or not subbed, and the hydrophilic crosslinked layer there may be provided a layer containing borax to advance the coagulation of the polyvinyl alcohol matrix.

After the toner image has been transferred to the toner receiving plate, the toner image is fixed to the plate by infrared radiation. As a typical infrared radiation fusing arrangement, the toner imaged surface is passed beneath an infrared radiator. The radiator attains a filament temperature in the range of 2000° to 3000° C. The radiator may be provided with a reflective coating or a reflective coating may be provided around the lamp. The irradiating temperature may be adjusted through variation of the power to the infrared radiator. At the rear side of the plate another infrared radiator or another heating element may be provided. Experiments have shown that to obtain the high running length benefits the surface of the plate must be brought to a temperature above 140° C. by irradiating for ½ to 1 second.

When no precautionary measures are taken the plastic film support of the toner receiving plate will irreversibly shrink when brought at temperatures above 140° C. In addition to shrinking the plate may be deformed such that mounting on a printing press becomes impossible. Since one wants to obtain a true, faithful reproduction of the original to be copied, dimensional instability is detrimental to the quality of the copy and has to be avoided.

Therefore according to the present invention a thermostable plastic film support as defined hereinbefore, is used.

Examples of plastic film supports for use according to the present invention include polyester, e.g. polyethylene terephthalate; polycarbonate; polyphenylenesulfide; polyetherketone; polyethylene terephthalate being preferred.

Thermostable polyethylene terephthalate film support for use in the present invention is obtained by heat-relaxing biaxially oriented polyethylene terephthalate film whereby internal stresses in the biaxially oriented film are allowed to relax.

The polyethylene terephthalate film to be heat-relaxed has been previously biaxially stretched and heat-set to achieve enhanced crystallinity. The techniques and principles employed to biaxially stretch and heat-set polyesters are well known. In general, stretching is carried out when the film is heated to temperatures above the glass transition temperature but below the melting temperature of the polymer. The heated film is stretched longitudinally and subsequently transversely. To enhance the crystallinity and to increase the dimensional stability of the stretched film, it is heat-set by heating it above its glass transition temperature but below its melting temperature (usually between 150° and 230° C.) while maintaining its length and width dimensions constant.

Biaxially oriented polyester films, although heat-set will shrink if later employed at high temperatures. This can be avoided by heat-relaxing or preshrinking the film at temperatures above the temperature at which the film will be used later on, and by simultaneously allowing the film to shrink (relax) in both dimensions. Heat-relaxing devices are described in e.g. U.S. Pat. No. 2,779,684, U.S. Pat. No. 4,160,799 and U.S. Pat. No. 3,632,726 and in references cited therein.

Heat-relaxed biaxially oriented polyethylene terephthalate film exhibits a high degree of dimensional stability and resistance to shrinkage at elevated temperatures up to the heat-relaxing temperature.

After the toner image has been fixed to the toner receiving plate of the present invention the plate is ready for printing. The oleophilic toner image areas form the ink receptive portions and the non-toned hydrophilic background areas form the water receptive portions. No further processing or development is required to effect this differential hydrophilic-hydrophobic characteristic.

The toner imaged plate mounted on a printing press, inked with a conventional lithographic greasy or fatty ink in the areas containing fixed toner and wetted with a conventional lithographic aqueous damping liquid in the still bare hydrophilic layer parts, yields several thousands of good-quality copies.

The following examples illustrate the invention without however limiting it thereto.

EXAMPLE 1

Toner Preparation 90 parts of ATLAC T500 (tradename of Atlas Chemical Industries Inc., Wilmington, Del., USA) being a proxylated bisphenol A fumarate polyester with a glass transition temperature of 58° C., a melting point in the range of 65° C. to 85° C., an acid number of 13.9, and an intrinsic viscosity measured at 25° C. in a mixture of phenol/ortho dichlorobenzene (60/40 by weight) of 0.175, and 10 parts of CABOT REGAL 400 (trade name of Cabot Corp., Boston, Mass., USA) being a carbon black, were introduced in a kneader and heated at 120° C. to form a melt, upon which the kneading process was started. After about 30 minutes, the kneading was stopped and the mixture was allowed to cool to room temperature (20° C.). At that temperature the mixture was crushed and milled to form a powder.

Milling and air classification was carried out employing an apparatus such as the A.F.G. (Alpine Fliessbeth Gegenstrahlmühle) type 100 as milling means, equipped with an A.T.P. (Alpine Turboplex Windsichter) type 50 GS, as air classification means and an Alpine Multiplex Labor Zich-zachsichter, type 100 MZR as additional classification apparatus (all models available form Alpine Process Technology).

Hereupon, the toner particles were introduced in a mixing apparatus. Aerosil R812 (a trade name of Degussa AG, Germany) being a fumed silica with a specific surface of 250 $m^2/g$ and an average particle diameter of 7 nm, the surface being hydrophobic, was admixed to the toner, and said mixture was then intensively shaken for about 30 minutes to enhance its flowability.

The size distribution was determined in a Coulter Multisizer apparatus with a measuring tube of 70 micron, the results of which are set forth hereunder. Column 2 of this table lists the differential percentages of toner particles by volume situated between the equivalent spherical diameter (in microns) set forth in column 1. Column 3 sets forth the percentage values of column 2 on a cumulative basis.

| diameter | dif. vol. % | cum. vol. % |
|---|---|---|
| 1.59 | 0.15 | 100.00 |
| 2.00 | 0.61 | 99.85 |
| 2.52 | 3.00 | 99.24 |
| 3.18 | 10.92 | 96.24 |
| 4.01 | 26.79 | 85.32 |

-continued

| diameter | dif. vol. % | cum. vol. % |
|---|---|---|
| 5.05 | 45.02 | 58.53 |
| 6.36 | 12.00 | 13.51 |
| 9.01 | 0.68 | 1.51 |
| 10.09 | 0.07 | 0.83 |
| 12.71 | 0.14 | 0.76 |
| 16.01 | 0.29 | 0.62 |
| 20.17 | 0 | 0.33 |

97.04% by volume of the toner particles have an equivalent diameter larger than 3 microns, 85.41% by volume have an equivalent diameter larger than 4 microns, 59.87% by volume have an equivalent diameter larger than 5 microns, 8.74% by volume have an equivalent diameter larger than 7 microns and 0.53% by volume have an equivalent diameter larger than 10 microns.

The average diameter by volume ($d_v$) of the obtained toner particles was 5.11 microns, the average diameter by number ($d_n$) was 4.10 microns and the mean diameter being $(d_v \times d_n)^{\frac{1}{2}}$ was 4.6 microns.

Developer Preparation

A magnetic brush developer was obtained by mixing the obtained toner with a typical carrier such as a ferrite carrier (Ni-Zn type) with a magnetization of 50 EMU/g. The average carrier particle diameter was about 65 microns.

After addition of the toner particles to the carrier in a concentration of 4% by weight the developer is activated by rolling in a metal box with a diameter of 6 cm at 300 rpm, during a period of 30 minutes with an apparent degree of filling of 30% by volume.

Preparation of the $TiO_2$ Dispersion 11 kg of polyvinylalcohol (PVA) was added to 308.56 l of water and was heated to 90° C. while being stirred slowly. The mixture was kept at 90° C. for 30 minutes and was thereafter cooled to 25° C.

To this mixture was added while being stirred slowly an amount of 17.6 mg of formaldehyde as biocide and 8 l of hydrogen chloride 1.2N. Stirring was continued for 5 minutes.

Thereafter 100 kg of the commercially available $TiO_2$ BAYERTITAN R-KB 2, sold by Bayer AG, Leverkusen, W. Germany, was added slowly while being stirred efficiently. Stirring was continued for 15 minutes.

The resulting mixture was thereafter treated in a ball mill apparatus Dynomill type KD 15 using $ZrO_2$ pearls with diameters between 0.8 and 1.25 mm with the following settings: flow = 3 l/min, peripheral velocity = 16 m/s, temperature between 40° and 50° C., in order to break-down the remaining $TiO_2$ powder aggregates.

Preparation of the Carbon Black Dispersion 200 g of polyvinylalcohol was added to 3800 ml of water at room temperature while being stirred. The mixture was heated to 90° C. and stirring was continued until complete dissolution (approximately 30 minutes).

150 g of HYAMINE 10X sold by Rohm-Haas being a diisobutylcresoxyethoxyethyl dimethyl benzyl ammonium chloride, as dispersing agent, was added to 4800 ml of water and was dissolved slowly. To this solution was added the commercially available non-beaded carbon black PRINTEX U sold by Degussa, in an amount of 1000 g while being stirred. The polyvinylalcohol solution was added hereto while being stirred slowly. Hydrogen chloride 1.2N was added in an amount to obtain a pH value of 3; approximately 50 ml was needed.

This predispersion was treated three times in a ball mill apparatus Dyno Mill type KDL with the following settings: 4500 t/min, glass pearls Dragoniet 31/7 with diameter between 0.5 and 0.7 mm, flow=15 l/h, temperature between 20° and 25° C., in order to breakdown the remaining carbon black powder aggregates.

Preparation of the Hydrolyzed Tetramethyl Orthosilicate (TMOS)

24 l of ethanol was brought in a reactor. Hereto was added: 12.48 kg of tetramethyl orthosilicate and 1135 ml of water. Another 15 l of ethanol was added through a separatory funnel. Subsequently a mixture of 1510 ml of water and 170 ml of hydrogen chloride was added while being stirred. Stirring was continued for 2 hours. The mixture was cooled to 10° C. and stored.

Preparation of Toner Receiving Plates

A toner receiving plate $R_1$ was prepared by coating on a subbed, 125 microns thick polyethylene terephthalate film that was heat-relaxed at 180° C. in order to be thermostable to 160° C., a composition containing the following ingredients: 2100 g of the $TiO_2$ dispersion, 810 ml of water, 1100 ml of PVA 5%, 500 ml of TMOS, 200 g of the carbon black dispersion, wetting agents and sodium hydroxide in an amount to obtain a pH value of 6. The wet thickness of the layer was 50 microns. After drying a layer having a reflection density in the visible spectrum of 0.8 was obtained.

A toner receiving plate $R_2$ was prepared analogously to $R_1$ with the exception that a borax layer was provided between the support and the PVA layer. The borax layer was coated from a composition containing 972.5 ml of water, 7.5 g of borax and wetting agents. The pH of the coating composition was 11 and the wet thickness of the borax layer was 20 microns.

A toner receiving plate $R_3$ was prepared by coating on a subbed, 125 microns thick polyethylene terephthalate film that was heat-relaxed at 180° C. in order to be thermostable to 160° C., a composition containing the following ingredients: 2100 g of the $TiO_2$ dispersion, 1260 ml of water, 1100 ml of PVA 5%, 50 ml of melamine formol 75%, 200 g of the carbon black dispersion, wetting agents and sodium hydroxide in an amount to obtain a pH value of 4. The wet thickness of the layer was 50 microns. After drying a layer having a reflection density in the visible spectrum of 0.8 was obtained.

A toner receiving plate $R_4$ was prepared analogously to $R_3$ with the exception that the pH of the PVA layer was 6 and that a borax layer analogous to the borax layer of $R_2$ was provided between the support and the PVA layer.

A toner receiving plate $R_5$ was prepared analogously to $R_1$ with the exception that hydrolyzed tetraethyl orthosilicate was used instead of hydrolyzed tetramethyl orthosilicate.

A toner receiving plate $R_6$ was prepared analogously to $R_5$ with the exception that a borax layer analogous to the borax layer of $R_2$ was provided between the support and the PVA layer.

A toner receiving plate $R_7$ was prepared analogously to $R_1$ with the exception that the coating composition also contained 10 ml of glycerine as plasticizing agent.

A toner receiving plate $R_8$ was prepared analogously to $R_1$ with the exception that the coating composition also contained 10 ml of sorbitol as plasticizing agent.

Development and Transfer

An electrostatic image formed on an electrophotographic recording element, i.e. an $As_2Se_3$ coated conductive drum, which was positively charged by means of a corona-grid discharge and imagewise exposed in an optical scanning apparatus with a moving original and a fixed 305 mm lens, was developed by a magnetic brush with the obtained developer.

The transfer of the electrostatically deposited toner proceeded by applying a positive voltage of 7 kV to a DC transfer corona, which was kept in close contact with the rear side of the toner receiving plate whose front side was therefore kept in close contact with the toner image on the photoconductor. An AC corona discharge was applied to the back of the receiving plate immediately following the application of the DC transfer corona to facilitate removing the receiving plate with the transferred toner image from the photoconductor surface.

Fixation

The toner imaged plate was fed to a fusing device operating with an infrared radiator provided with a reflective coating. At the rear side of the receiving plate a heating plate was provided. The infrared radiator was located at a distance of 10 mm from the toner imaged plate surface which was caused to move past the radiator at a rate of 5 cm/s.

The heating plate was brought to a temperature of 125° C. A power of 550 W was applied to the infrared radiator corresponding to a temperature of about 2600 K. The plate was irradiated for about ½ to 1 second.

Evaluation of Copy Quality

The obtained printing plate carrying a positive toner reproduction of the screen original was mounted on a lithographic printing press and used for printing with a conventional fountain solution and lithographic ink.

The development, transfer, fixation and printing step was repeated for each of the obtained toner receiving plates.

The printed screen resolution obtained was 10–90% dot at a screen ruling of 100 lines per inch. For each of the toner receiving plates about 20000 reproductions of excellent quality were obtained.

EXAMPLE 2

Toner receiving elements were prepared analogously to $R_1$ but with different amounts of carbon black so that the reflection density of the PVA layer in the visible spectrum was respectively 0, 0.4 and 0.8.

These plates were processed as in example 1.

The wearability of the respective plates was tested by the running length of copies with good reproduction of a screen of 10% dot at 100 lines per inch. The running lengths were respectively 10000, 17000 and 25000.

These results show that by incorporating carbon black in the PVA layer the small dot areas are fused more efficiently so that more printing copies with the desired resolution can be obtained.

EXAMPLE 3

Toner receiving elements analogous to $R_1$ were prepared and processed as in example 1 with the exception that the radiation power in the fixation step was respectively 400 W, 500 W and 600 W.

The wearability of the plate was tested by the running length of copies with good reproduction of a screen of 10% dot at 100 lines per inch. Fixed at 400 W the plate yielded 500 copies, fixed at 500 W 10000 copies and fixed at 600 W 25000 copies.

These results show that by increasing the fusing temperature the small dot areas are fused more efficiently so that more printing copies with the desired resolution can be obtained.

We claim:

1. Electrophotographic method of obtaining lithographic printing plates comprising the following steps: (i) uniformly electrostatically charging a photoconductor element, (ii) image-wise discharging said photoconductor element, (iii) developing the resulting electrostatic charge pattern with dry toner particles of which more than 90% by volume have an equivalent particle size diameter less than 10 microns and more than 50% by volume have an equivalent particle size diameter less than 7 microns, (iv) electrostatically transferring the developed image to a toner receiving plate, said toner receiving plate comprising a plastic film support that is thermostable to a temperature of at least 140° C. and a crosslinked hydrophilic layer thereon, said layer containing infrared absorbing substances in such an amount that the reflection density of said layer in the visible spectrum is between 0.4 and 1.4, and (v) fixing the transferred toner to said toner receiving plate by infrared radiation fusing.

2. Electrophotographic method of obtaining lithographic printing plates according to claim 1, wherein more than 70% by volume of the dry toner particles have an equivalent particle size diameter between 4 and 6.5 microns.

3. Electrophotographic method of obtaining lithographic printing plates according to claim 1, wherein the toner particles contain carbon black.

4. Electrophotographic method of obtaining lithographic printing plates according to claim 1, wherein the toner particles contain a resin binder of which the glass transition temperature is higher than 50° C. and the viscosity at 100 rad/s and 120° C. is lower than 15000 P.

5. Electrophotographic method of obtaining lithographic printing plates according to claim 1, wherein the plastic film support is polyethylene terephthalate.

6. Electrophotographic method of obtaining lithographic printing plates according to claim 5, wherein the polyethylene terephthalate support is thermostable to a temperature of 160° C.

7. Electrophotographic method of obtaining lithographic printing plates according to claim 1, wherein the crosslinked hydrophilic layer comprises a hydrophilic (co)polymer or (co)polymer mixture of which the hydrophilicity is the same as or higher than the hydrophilicity of polyvinyl acetate hydrolyzed to at least an extent of 60 percent by weight.

8. Electrophotographic method of obtaining lithographic printing plates according to claim 7, wherein the crosslinked hydrophilic layer comprises polyvinyl alcohol.

9. Electrophotographic method of obtaining lithographic printing plates according to claim 1, wherein the crosslinked hydrophilic layer comprises hydrolyzed tetramethyl orthosilicate or hydrolyzed tetraethyl orthosilicate.

10. Electrophotographic method of obtaining lithographic printing plates according to claim 1, wherein the crosslinked hydrophilic layer contains a pigment.

11. Electrophotographic method of obtaining lithographic printing plates according to claim 10, wherein the pigment is titanium dioxide.

12. Electrophotographic method of obtaining lithographic printing plates according to claim 1, wherein the infrared absorbing substance is carbon black.

13. Electrophotographic method of obtaining lithographic printing plates according to claim 12, wherein the particle size of the carbon black is less than 1 micron.

14. Electrophotographic method of obtaining lithographic printing plates according to claim 1, wherein the crosslinked hydrophilic layer has a reflection density in the visible spectrum between 0.6 and 1.

15. Electrophotographic method of obtaining lithographic printing plates according to claim 1, wherein the crosslinked hydrophilic layer contains titanium dioxide, polyvinyl alcohol in an amount of between 15 and 30% by weight based on the amount of titanium dioxide, hydrolyzed tetra(m)ethyl orthosilicate in an amount corresponding to between 15 and 30% by weight of tetra(m)ethyl orthosilicate based on the amount of titanium dioxide, and carbon black in an amount of between 1 and 10% by weight based on the amount of titanium dioxide.

* * * * *